US010937607B2

(12) United States Patent
Arai

(10) Patent No.: US 10,937,607 B2
(45) Date of Patent: Mar. 2, 2021

(54) ELECTRONIC SWITCH AND REMOTE CONTROL DEVICE INCLUDING ELECTRONIC SWITCH

(71) Applicants: CITIZEN ELECTRONICS CO., LTD., Yamanashi-ken (JP); CITIZEN WATCH CO., LTD., Tokyo (JP)

(72) Inventor: Takahiro Arai, Yamanashi-ken (JP)

(73) Assignees: CITIZEN ELECTRONICS CO., LTD., Yamanashi-Ken (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 16/868,904

(22) Filed: May 7, 2020

(65) Prior Publication Data

US 2020/0266011 A1 Aug. 20, 2020

Related U.S. Application Data

(62) Division of application No. 15/884,743, filed on Jan. 31, 2018, now Pat. No. 10,699,855.

(60) Provisional application No. 62/454,209, filed on Feb. 3, 2017.

(51) Int. Cl.

| | |
|---|---|
| ***H01H 13/14*** | (2006.01) |
| ***H01H 13/04*** | (2006.01) |
| ***H01H 13/10*** | (2006.01) |
| ***H01H 13/48*** | (2006.01) |
| ***H01H 13/705*** | (2006.01) |
| *H01H 9/00* | (2006.01) |

(52) U.S. Cl.

CPC ..... *H01H 13/14* (2013.01); *H01H 13/04* (2013.01); *H01H 13/10* (2013.01); *H01H 13/48* (2013.01); *H01H 13/705* (2013.01); *H01H 2009/0083* (2013.01); *H01H 2221/002* (2013.01); *H01H 2221/05* (2013.01); *H01H 2221/072* (2013.01); *H01H 2231/032* (2013.01); *H01H 2239/03* (2013.01); *H01H 2300/024* (2013.01)

(58) Field of Classification Search

CPC ..... H01H 13/48; H01H 2215/004; H01H 2227/026; H01H 13/52; H01H 2203/038; H01H 2205/016; H01H 13/04; H01H 2227/022; H01H 2215/036; H01H 2215/012; H01H 13/14; H01H 13/705; H01H 2231/032; H01H 2009/0083; H01H 2221/05; H01H 2300/024; H01H 2239/03; H01H 2221/002; H01H 2221/072

See application file for complete search history.

(56) References Cited

U.S. PATENT DOCUMENTS

| | | | |
|---|---|---|---|
| 5,898,147 | A | 4/1999 | Domzalski |
| 6,344,791 | B1 | 2/2002 | Armstrong |
| 2010/0038225 | A1 | 2/2010 | Furuoya |
| 2013/0068599 | A1 | 3/2013 | Kikuchi |

FOREIGN PATENT DOCUMENTS

| | | |
|---|---|---|
| JP | 2013-77552 | 4/2013 |

*Primary Examiner* — Ahmed M Saeed

(74) *Attorney, Agent, or Firm* — Wenderoth, Lind & Ponack, L.L.P.

(57) ABSTRACT

An electronic switch includes a rubber sheet that includes a first surface, a second surface opposite to the first surface, and a convex portion on the first surface. The convex portion of the rubber sheet includes a semispherical shape.

5 Claims, 11 Drawing Sheets

ELECTRONIC SWITCH AND REMOTE CONTROL DEVICE INCLUDING ELECTRONIC SWITCH

CROSS-REFERENCE TO RELATED APPLICATION

This is a division from the U.S. patent application Ser. No. 15/884,743 filed on Jan. 31, 2018 which is based on, and claims benefit of U.S. provisional application No. 62/454,209 filed on Feb. 3, 2017, the disclosure of which is incorporated herein by reference in its entirety.

BACKGROUND

Technical Field

The present application relates to an electronic switch, an electronic device including an electronic switch, and a remote control device including the electronic switch.

Discussion of the Background

The statements in this section merely provide background information related to the present disclosure and do not necessarily constitute prior art.

JP laid-open application No. JP2013-77552 discloses a switch enabling a long life and shock-proof improvement by suppressing a load to a movable electrode while responding to a request for miniaturization. The switch includes a case mounted on a circuit board and formed with a recess, a plurality of fixed electrodes, a movable electrode, and a pressing member. The movable electrode is provided in the recess of the case, and displaced between a first position where the fixed electrodes are electrically connected to each other and a second position where the fixed electrodes are insulated from each other. The pressing member covers the recess and displaces the movable electrode from the second position to the first position when a pressing force from outside is applied to the pressing member. The pressing member is elastically deformed by the pressing force so that a contact area between the pressing member and the movable electrode is increased.

SUMMARY

In a first aspect of the subject matter, an electronic switch includes a rubber sheet that includes a first surface, a second surface opposite to the first surface, and a convex portion on the first surface, the convex portion of the rubber sheet including a semispherical shape.

In a second aspect of the subject matter, an electronic switch includes a rubber sheet that includes a first surface, a second surface opposite to the first surface, and a convex portion on the first surface; a resin body including a first contact and a second contact that is positioned outside the first contact; a spring plate that includes a central portion arranged over the first contact and a peripheral portion arranged on the second contact of the resin body; and a cover sheet that includes a first surface, a second surface opposite to the first surface, and a protrusion on the second surface, and that is arranged to seal the spring plate that is positioned below the protrusion on the second surface of the cover sheet. Also, it is suggested that the convex portion of the rubber sheet has a height that is in a range of 50 to 100 percent of a length of a diameter at a bottom area of the convex portion of the rubber sheet.

In a third aspect of the subject matter, an electronic switch includes a substrate including a first surface, a second surface opposite to the first surface, a first electrode positioned on the first surface, and a second electrode positioned on the first surface around the first electrode; a frame sheet including a first surface, a second surface opposite to the first surface, and an opening that passes through the frame sheet from the first surface to the second surface, the frame sheet being arranged on the first surface of the substrate; a spring plate including a central portion, a peripheral portion around the central portion, a top portion of the central portion that includes a dome shape, and a lower portion of the peripheral portion, the spring plate being positioned in the opening of the frame sheet, the central portion of the spring plate being positioned over the first electrode, and the lower portion of the peripheral portion being positioned on the second electrode. The electronic switch further may include a protrusion that is positioned in contact with the top portion of the central portion of the spring plate; and a cover sheet including a first surface and a second surface opposite to the first surface, the protrusion being arranged on the second surface of the cover sheet. The second surface of the cover sheet is adhered to the first surface of the frame sheet to seal the spring plate positioned below the protrusion of the cover sheet in the opening of the frame sheet that is arranged on the first surface of the substrate. The electronic switch further includes a rubber sheet including a first surface, a second surface opposite to the first surface, and a convex portion being arranged on the first surface. The second surface of the rubber sheet may be arranged in contact with the first surface of the cover sheet. It is also suggested that the convex portion of the rubber sheet includes a bottom area with a diameter that is fit in the opening of the frame sheet in a plan view.

In a fourth aspect of the subject matter, an electronic device includes a circuit board; an electronic switch electrically mounted on the circuit board, the electronic switch including a rubber sheet including a first surface, a second surface opposite to the first surface, and a convex portion on the first surface, the convex portion of the rubber sheet including a semispherical shape; and a key top arranged above the convex portion of the rubber sheet of the electronic switch.

In a fifth aspect of the subject matter, a remote control device includes a circuit board; a first electronic switch that is electrically mounted on the circuit board, the first electronic switch including a first rubber sheet that includes a first surface, a second surface opposite to the first surface, and a convex portion on the first surface, the convex portion of the first rubber sheet including a semispherical shape; and a second electronic switch that is electrically mounted on the circuit board, the second electronic switch including a second rubber sheet that includes a first surface, a second surface opposite to the first surface, and a convex portion on the first surface, the convex portion of the rubber sheet including a semispherical shape.

BRIEF DESCRIPTION OF THE DRAWING

A more complete appreciation of the present disclosure and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1A:
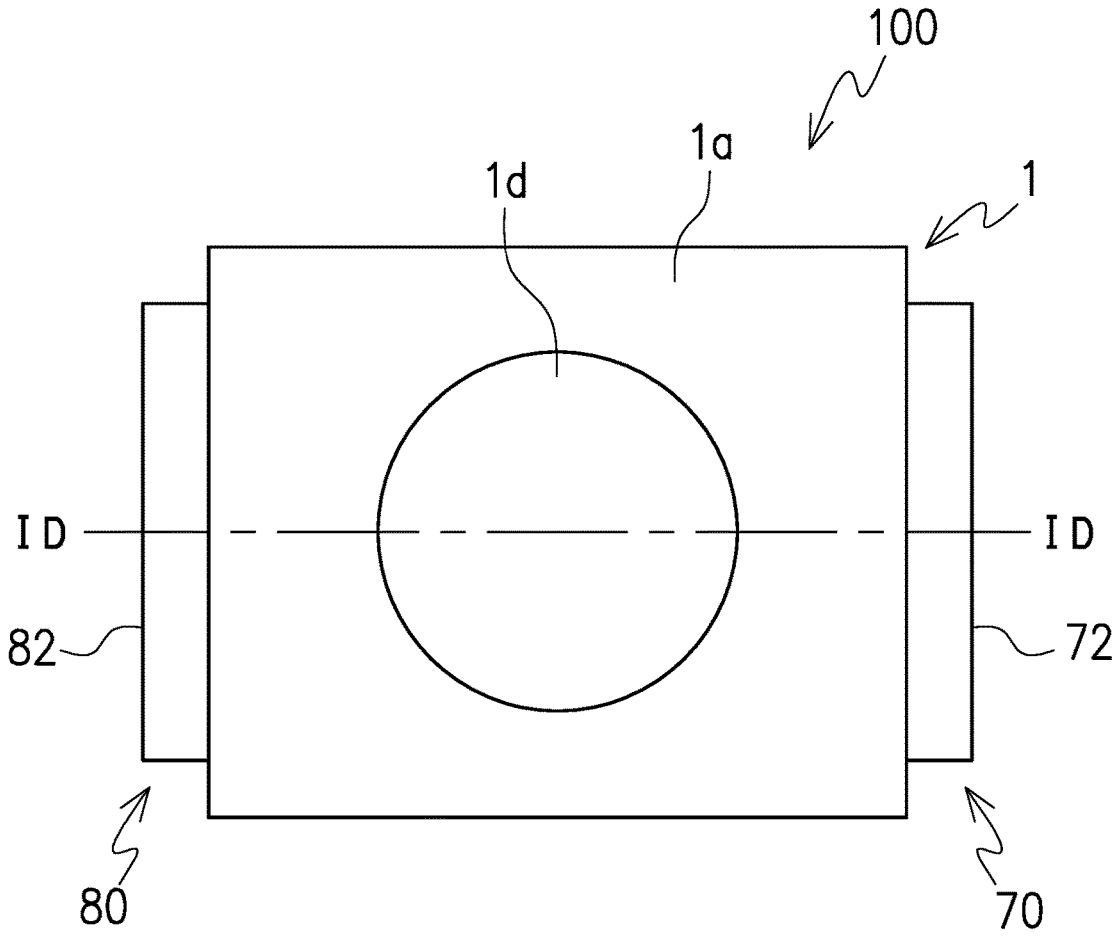
FIG. 1A is a plan view of an electronic switch according to a first embodiment of the present application.
Figure 1B:
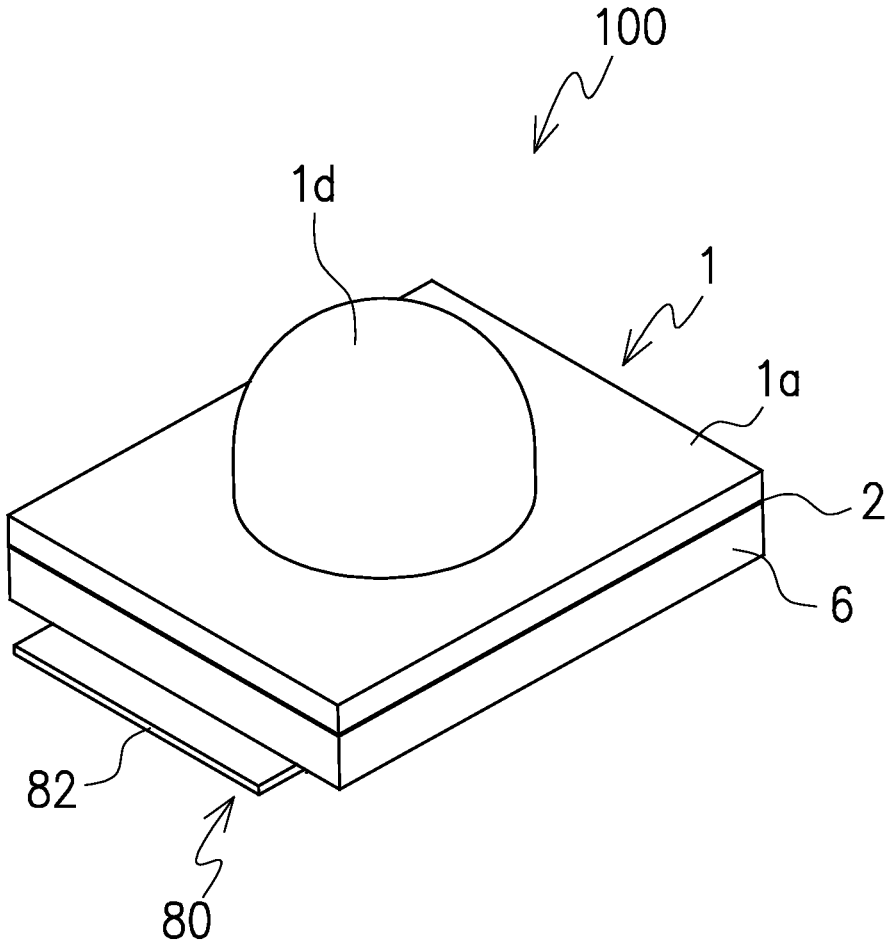
FIG. 1B is a top perspective view of the electronic switch illustrated in FIG. 1A.
Figure 1C:
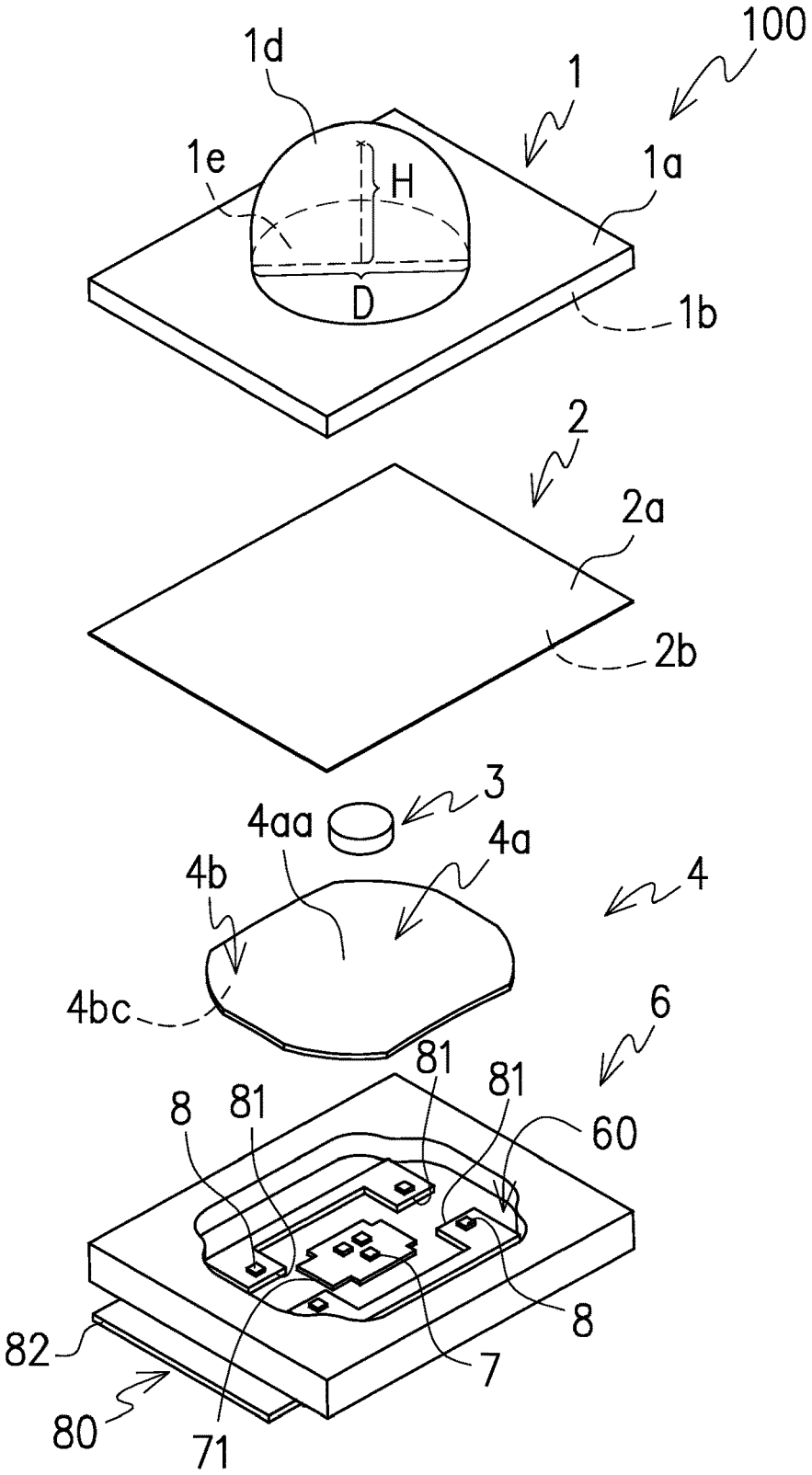
FIG. 1C is an exploded perspective view of the electronic switch illustrated in FIG. 1A.
Figure 1D:
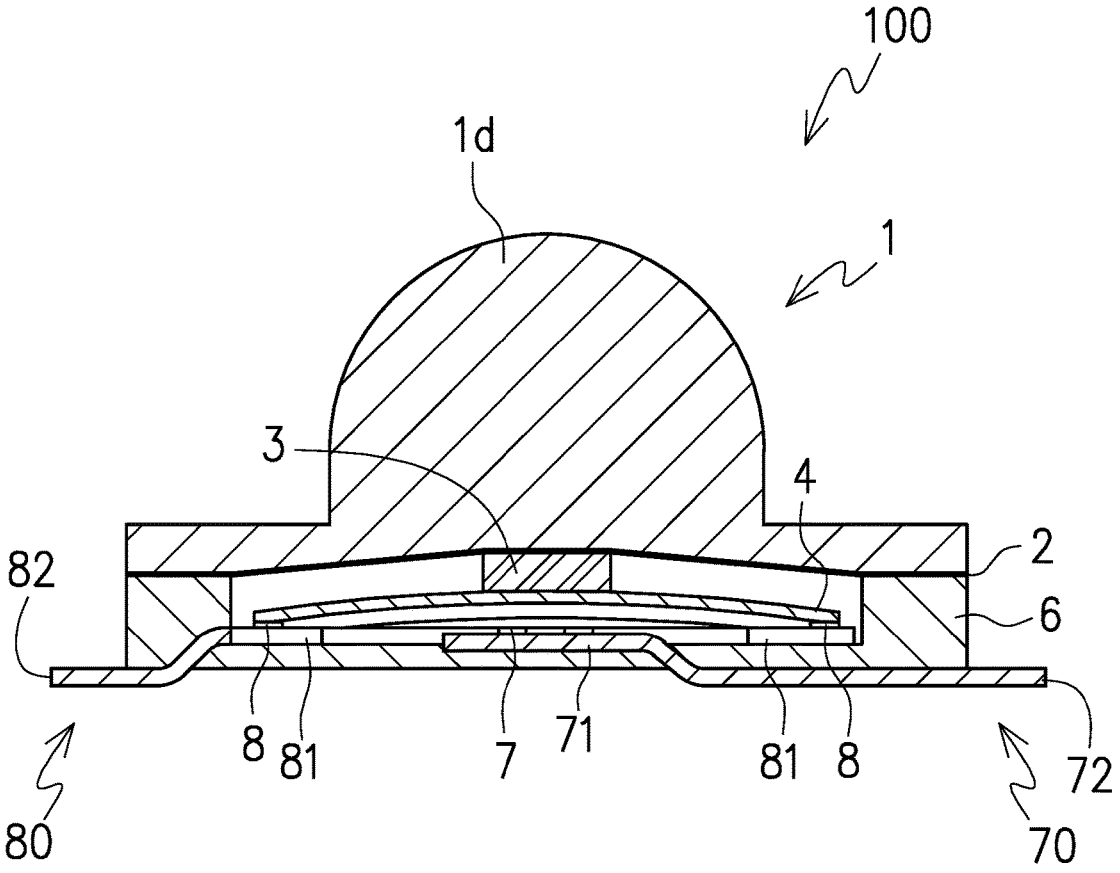
FIG. 1D is a cross-sectional view of the electronic switch, taken along a dot-and-dash line ID-ID of FIG. 1A.
Figure 2A:
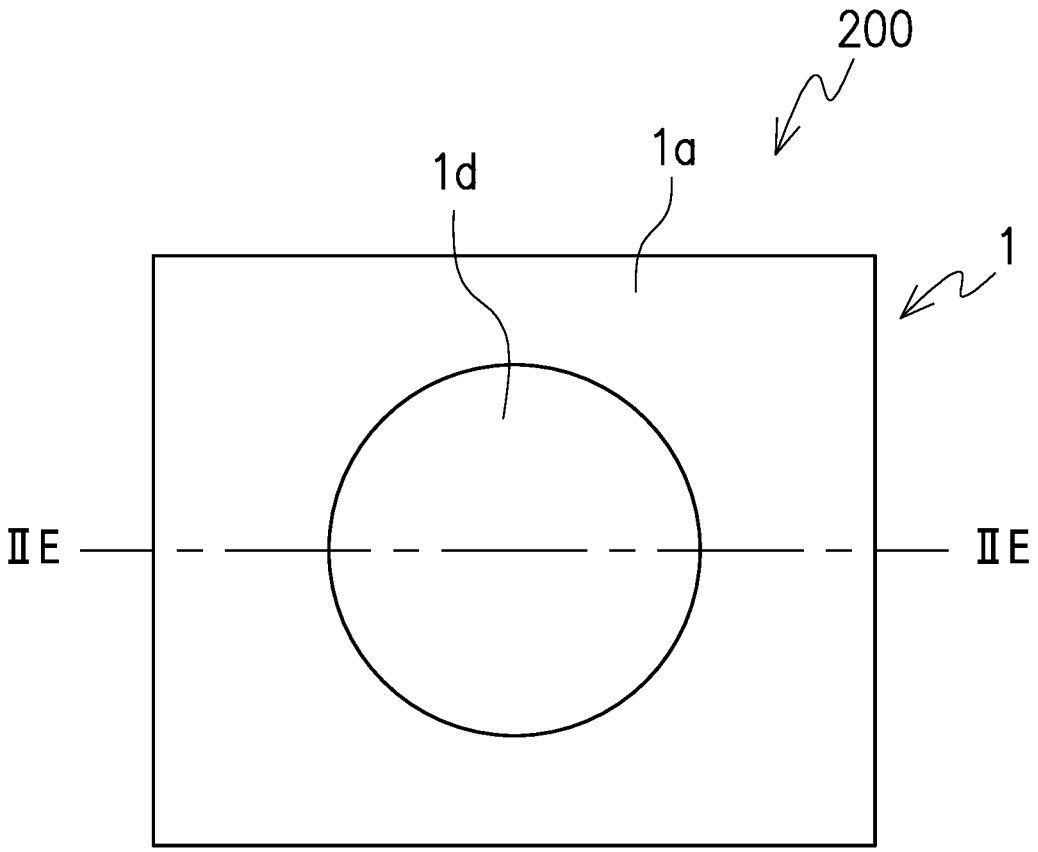
FIG. 2A is a plan view of an electronic switch according to a second embodiment of the present application.
Figure 2B:
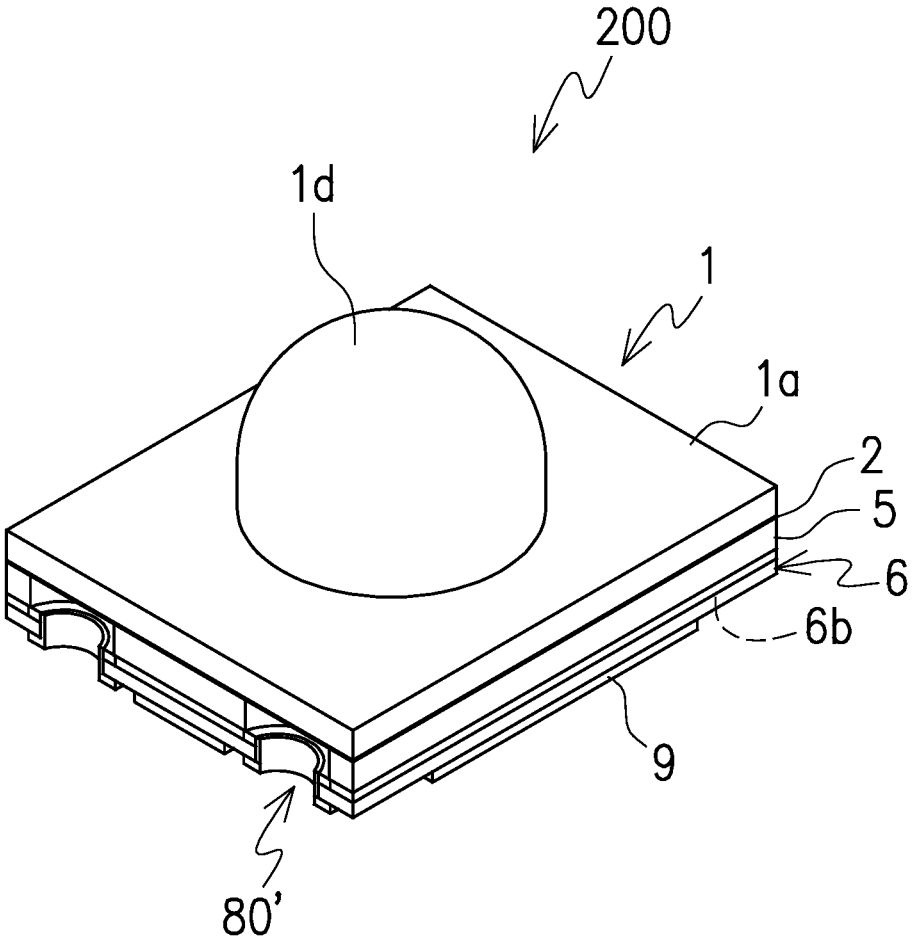
FIG. 2B is a top perspective view of the electronic switch illustrated in FIG. 2A.
Figure 2C:
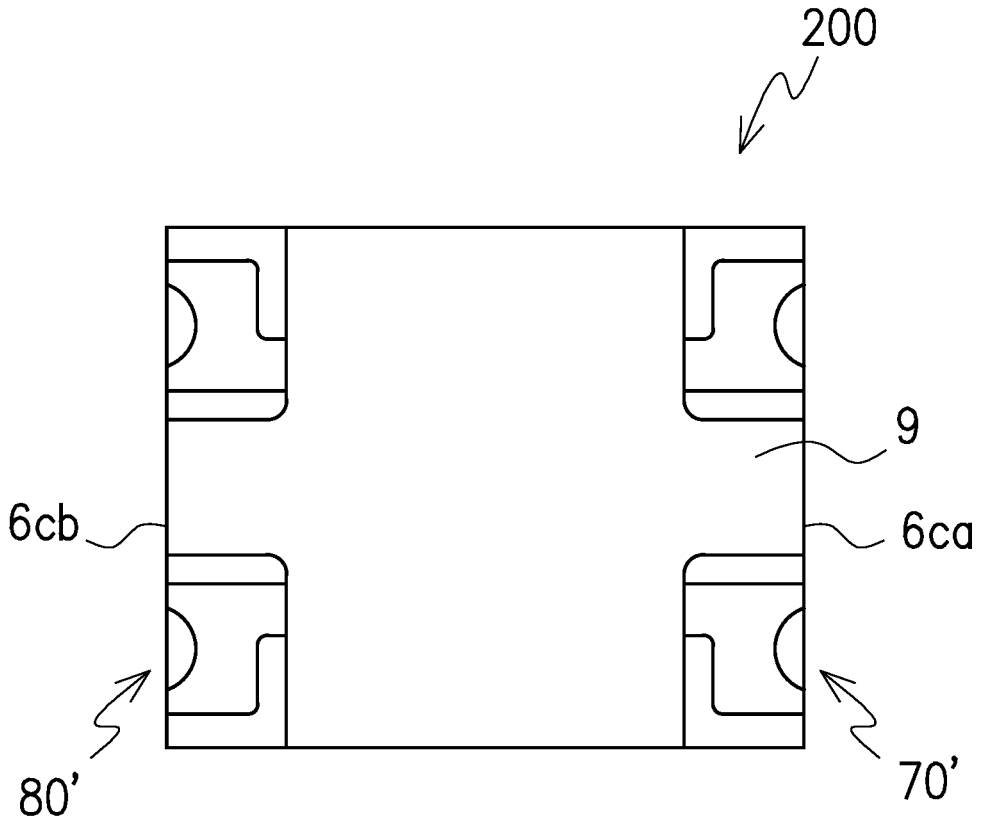
FIG. 2C is a bottom plan view of the electronic switch illustrated in FIG. 2A.
Figure 2D:
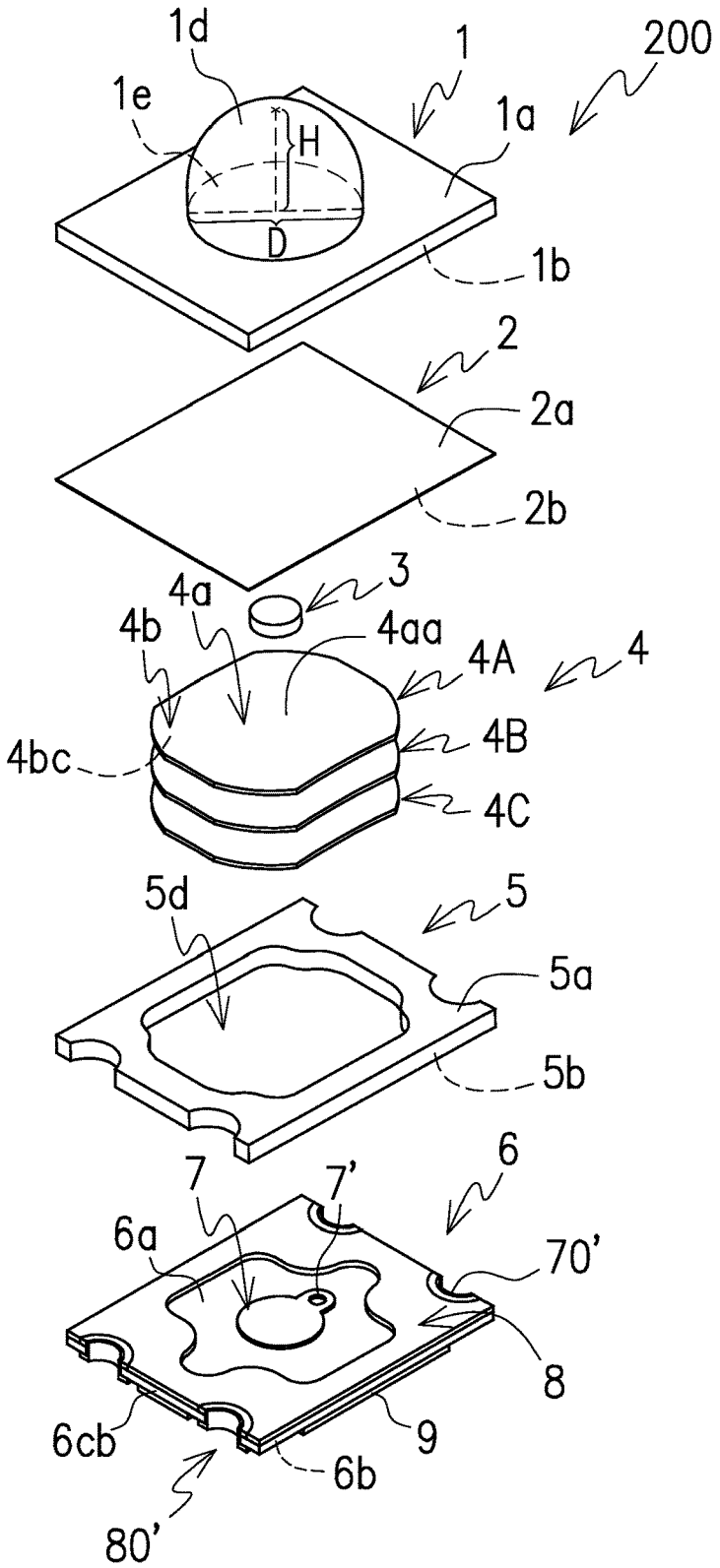
FIG. 2D is an exploded perspective view of the electronic switch illustrated in FIG. 2A.
Figure 2E:
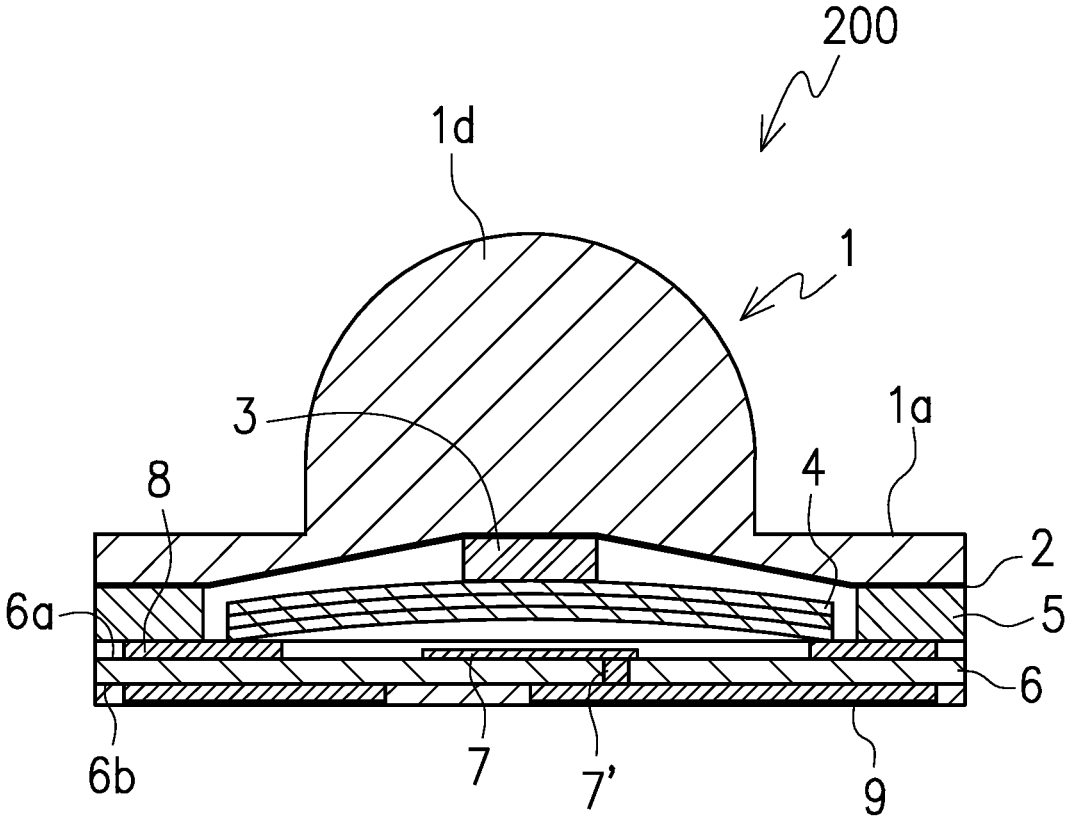
FIG. 2E is a cross-sectional view of the electronic switch, taken along a dot-and-dash line IIE-IIE of FIG. 2A.

Embodiments of the subject matter now will be described in further detail hereinafter with reference to the attached figures. In the figures, identical or corresponding constituents are identified using the same reference numerals, and redundant description is omitted. Also the figures are not necessarily to scale, as the size of some of the structures or portions of the figures may be exaggerated relative to other structures or portion for illustrative purposes. Further, some of the figures are schematically illustrated to facilitate understanding of the structure represented therein.

While the specification and drawings detail certain example embodiments of the subject matter, the subject matter may, however, be embodied in many different forms and should not be construed as limited to the embodiments set forth herein. Rather, these example embodiments are provided so that this disclosure will be thorough and complete, and will fully convey the scope of the subject matter to those skilled in the art.

As used herein, the term "and/or" includes any and all combinations of one or more of the associated listed items. The terminology used herein is for the purpose of describing particular example embodiments only and is not intended to be limiting of the subject matter. As used herein, the singular forms "a", "an" and "the" are intended to include the plural forms as well, unless the context clearly indicates otherwise. Relative terms such as "below" or "above" or "upper" or "lower" or "top" or "bottom" may be used herein to describe a relationship of one element, layer or region to another element, layer or region as illustrated in the figures. It will be understood that these terms are intended to encompass different orientations of a device in addition to the orientation depicted in the figures.

An electronic switch 100 according to a first embodiment of the present application will be described with reference to FIG. 1A to FIG. 1D. The electronic switch 100 includes a rubber sheet 1 that includes a first surface 1*a*, a second surface 1*b* opposite to the first surface 1*a*, and a convex portion 1*d* on the first surface 1*a*. The convex portion 1*d* of the rubber sheet 1 may include a semispherical shape. The rubber sheet 1 may be made of a material containing a silicone rubber. Also, the rubber sheet 1 may be made of a material containing a fluorine-containing rubber. The convex portion 1*d* of the rubber sheet 1 is not hollow but filled with a same material of the rubber sheet 1. The rubber sheet 1 including the convex portion 1*d* may be molded by a die, for example.

As noted above, the electronic switch 100 according to the first embodiment includes the rubber sheet 1 with the first surface 1*a*, the second surface 1*b* opposite to the first surface 1*a*, and the convex portion 1*d* on the first surface 1*a*. The electronic switch 100 may also include a resin body 6 that includes a first contact 7 and a second contact 8 that is positioned outside the first contact 7. The electronic switch 100 may further include a spring plate 4 that includes a central portion 4*a* arranged over the first contact 7 and a peripheral portion 4*b* arranged on the second contact 8 of the resin body 6. The electronic switch 100 may include a cover sheet 2 including a first surface 2*a*, a second surface 2*b* opposite to the first surface 2*a*, and a protrusion 3 on the second surface 2*b*. The cover sheet 2 may be arranged on the resin body 6 to seal the spring plate 4 that is positioned below the protrusion 3 on the second surface 2*b* of the cover sheet 2. The protrusion 3 positioned on the second surface 2*b* of the cover sheet 2 may be in contact with a top portion 4*aa* of the spring plate 4.

The convex portion 1*d* of the rubber sheet 1 has a height H that is in a range of 50 to 100 percent of a length of a diameter D at a bottom area 1*e* of the convex portion 1*d* of the rubber sheet 1.

The cover sheet 2 may be made of a material containing a polyimide. Also, the cover sheet 2 may be made of a material containing a polyether ether ketone (PEEK) resin. The cover sheet 2 may be made of a material containing a fluorine resin. The protrusion 3 may be adhered to a second surface 2*b* of the cover sheet 2. Also, it is possible to obtain a cover sheet with a protrusion from a thermoplastic resin sheet by molding, for example.

As noted above, the electronic switch 100 according to the first embodiment may include the single spring plate 4. The spring plate 4 may be made of stainless steel, for example. The spring plate 4 may also be made of alloy steel, nickel alloy, aluminum alloy, and/or titanium, for example. The spring plate 4 may be cut out from a metal plate. The spring plate 4 includes the central portion 4*a*, the peripheral portion 4*b* around the central portion 4*a*, the top portion 4*aa* of the central portion 4*a* that includes a dome shape, and a lower portion 4*bc* of the peripheral portion 4*b*.

In the first embodiment, the resin body 6 may include a hollow portion 60. A first lead 70 including a first end 71 and a second end 72 is partly positioned in the resin body 6. A second lead 80 including a first end 81 and a second end 82 is also partly positioned in the resin body 6. The spring plate 4 may be positioned in the hollow portion 60 of the resin body 6. The central portion 4*a* of the spring plate 4 is positioned over the first electrode 7. The lower portion 4*bc* of the peripheral portion 4*b* of the spring plate 4 may be positioned on the second electrode 8.

Also, it is possible to arrange two or more spring plates 4 in the electronic switch 100. If two or more spring plates are layered, a loading to each of the two or more spring plates will be decreased, and thus, and the electronic switch may become more durable than an electronic switch including a single spring plate. The number of spring plates may be selectable depending cost, a required durability, and/or a required click feeling, for example.

As noted above, the resin body 6 may include the first lead 70 that is partly embedded in the resin body 6. The first contact 7 may be a part of the first lead 70. The resin body 6 may also include the second lead 80 that is partly embedded in the resin body 6. The second contact 8 may be a part of the second lead 80. The first contact 7 and the second contact 8 may be positioned in the hollow portion 60 of the resin body 6.

The first lead 70 may include the first end 71 that is positioned adjacent to the first contact 7 and the second end 72 that is positioned outside the resin body 6. The second end 72 of the first lead 70 may be soldered to a first electrode of a circuit board 1002 in an electronic device 1000, as illustrated in FIG. 3B, for example.

The second lead 80 may include the first end 81 that is positioned adjacent to the second contact 8 and the second end 82 that is positioned outside the resin body 6. The second end 72 of the first lead 70 may project from one side of the resin body 6, and the second end 82 of the second lead 80 may project from another side of the resin body 6.

The second end 82 of the second lead 80 may be soldered to a second electrode of the circuit board 1002 in the electronic device 1000, for example. The resin body 6 in which the first lead 70 and the second lead 80 are partly embedded electrically insulates the first lead 70 and the second lead 80.

When a pressing force is applied to the convex portion 1*d* of the rubber sheet 1 from above, the convex portion 1*d* of the rubber sheet 1 elastically deforms. However, securing a sufficient switch stroke of an electronic switch is sometimes required to avoid an unexpected start of function of an electronic device in which the electronic switch is installed. For example, if an electronic switch 100 is arranged in a remote control device that might be as small as a key for a keyless entry system, the remote control device may be expected to be carried in hand, in a pocket, and in a bag in which goods and/or belongings are contained together.

According to an embodiment of an electronic switch of the subject matter, the convex portion 1*d* of the rubber sheet 1 includes a round top, and thus, it is possible to secure a longer switch stroke length to its round top, as compared to another shape.

Also, the material of the rubber sheet 1 tends to elastically deform and is expected to have strength against an impact, which may sometimes occur in the hand, in a pocket, in a bag, etc. Furthermore, if the convex portion 1*d* of the rubber sheet 1 has a height H that is in a range of 50 to 100 percent of a length of a diameter D at the bottom area 1*e* of the convex portion 1*d*, a sufficient switch stroke is expected to be obtained.

An electronic switch 200 according to a second embodiment of the present application will be described with reference to FIG. 2A to FIG. 2E. The electronic switch 200 includes a rubber sheet 1 that includes a first surface 1*a*, a second surface 1*b* opposite to the first surface 1*a*, and a convex portion 1*d* on the first surface 1*a*. The convex portion 1*d* of the rubber sheet 1 may include a semispherical shape. Regarding the rubber sheet 1 in the second embodiment, the explanation in the first embodiment may be referred to.

The electronic switch 200 may include a resin body 6 that includes a first contact 7 and a second contact 8 that is positioned outside the first contact 7. The electronic switch 200 includes a spring plate 4 that includes a central portion 4*a* arranged over the first contact 7 and a peripheral portion 4*b* arranged on the second contact 8 of the resin body 6. The electronic switch 200 may include a cover sheet 2 including a first surface 2*a*, a second surface 2*b*, and a protrusion 3 on the second surface 2*b*. The cover sheet 2 is arranged to seal the spring plate 4. The protrusion 3 positioned on the second surface 2*b* of the cover sheet 2 may be in contact with a top portion 4*aa* of the spring plate 4.

The convex portion 1*d* of the rubber sheet 1 has a height H that is in a range of 50 to 100 percent of a length of a diameter D at a bottom area 1*e* of the convex portion 1*d*.

In the second embodiment, the resin body 6 may be a substrate. The substrate 6 may include a first through-hole 70' that is electrically connected to the first contact 7 that may also include a through-hole 7' that may be positioned adjacent to the first contact 7, may pass through the substrate 6, and may be electrically connected to the first through-hole 70', for example. Also, the substrate may include a second through-hole 80' that is electrically connected to the second contact 8.

The first contact 7 may be a first electrode arranged on a first surface 6*a* of the substrate 6. The first through-hole 70' may be arranged at a first side 6*ca* of the substrate 6. The first through-hole 70' may be a ½ through-hole electrically connected to the through-hole 7' that is positioned at the first contact 7. The second contact 8 may be a second electrode on the first surface 6*a* of the substrate 6. The second through-hole 80' may be arranged at a second side 6*cb* of the substrate 6, and the second side 6*cb* is the opposite side of the first side 6*ca* of the substrate 6. The second through-hole 80' may be a ½ through-hole. The explanation here about the contacts and the through-holes is just an example. It is noted that the positions and shapes of through-holes are freely selectable. A ¼ through-hole may be positioned at a corner of the substrate. Furthermore, a resist layer 9 may be arranged on a second surface 6*b* of the substrate 6 except at positions where the first through-hole 70' and the second through-hole 80' are positioned at the second surface 6*b* of the substrate 6, for example.

The spring plate 4 may include two or more spring plates. It is possible to arrange two or more spring plates that are layered. In this embodiment, three spring plates 4 (4A, 4B, 4C) are layered to decrease a loading to each of the spring plates. Compared to an electronic switch including a single spring plate, an electronic switch including two or more spring plates might be more durable. For example, in this embodiment, even if one of the spring plates is broken, two spring plates are left to give a sufficient click feeling to a user of an electronic device in which the electronic switch 200 is installed.

As noted above, the convex portion 1*d* of the rubber sheet 1 has the height H that is in a range of 50 to 100 percent of a length of the diameter D at the bottom area 1*e* of the convex portion 1*d* of the rubber sheet 1.

The rubber sheet 1 may be made of a material containing a silicone rubber. Also, the rubber sheet 1 may be made of a material containing a fluorine-containing rubber. The convex portion 1*d* of the rubber sheet 1 is not hollow but filled with a same material of the rubber sheet 1. The rubber sheet 1 including the convex portion 1*d* may be molded by a die, for example.

As also noted above, the electronic switch 200 according to the second embodiment includes the resin body 6. In this embodiment, the resin body 6 is the substrate 6 that includes the first surface 6*a*, the second surface 6*b* opposite to the first surface 6*a*, the first electrode 7 positioned on the first surface 6*a*, and the second electrode 8 positioned on the first surface 6*a* around the first electrode 7.

The electronic switch 200 further includes a frame sheet 5 that includes a first surface 5*a*, a second surface 5*b* opposite to the first surface 5*a*, and an opening 5*d* that passes through the frame sheet 5 from the first surface 5*a* to the second surface 5*b*. The frame sheet 5 is arranged on the first surface 6*a* of the substrate 6.

Also, the electronic switch 200 includes the spring plate 4. The spring plate 4 includes the central portion 4*a*, the peripheral portion 4*b* around the central portion 4*a*, the top portion 4*aa* of the central portion 4*a* that includes a dome shape, and a lower portion 4*bc* of the peripheral portion 4*b*. The spring plate 4 is positioned in the opening 5*d* of the frame sheet 5. The central portion 4*a* of the spring plate 4 is positioned over the first electrode 7. The lower portion 4*bc* of the peripheral portion 4*b* is positioned on the second electrode 8.

The electronic switch 200 further includes the protrusion 3 that may be positioned in contact with the top portion 4*aa* of the spring plate 4.

The electronic switch 200 may include the cover sheet 2. The cover sheet 2 includes the first surface 2*a* and the second surface 2*b* opposite to the first surface 2*a*. The cover sheet 2 may include the protrusion 3, and the second surface 2*b* of the cover sheet 2 may be adhered to the first surface 5*a* of the frame sheet 5 to seal the spring plate 4 positioned below the protrusion 3 in the opening 5*d* of the frame sheet 5 that is arranged on the first surface 6*a* of the substrate 6.

The protrusion 3 may be a part of the cover sheet 2. The protrusion 3 may be adhered to the second surface 2*b* of the cover sheet 2. Also, it is possible to arrange a cover sheet 2 that may be originated from a thermoplastic resin sheet. In this case, the cover sheet 2 and the protrusion 3 may be formed as a whole from a thermoplastic resin sheet.

As also noted above, the electronic switch 200 includes the rubber sheet 1. The rubber sheet 1 includes the first surface 1*a*, the second surface 1*b* opposite to the first surface 1*a*, and the convex portion 1*d*. The convex portion 1*d* is arranged on the first surface 1*a* of the rubber sheet 1. The second surface 1*b* of the rubber sheet 1 is arranged to be in contact with the first surface 2*a* of the cover sheet 2.

The convex portion 1*d* of the rubber sheet 1 includes the bottom area 1*e* with the diameter D that is fit in the opening 5*d* of the frame sheet 5 in a plan view. The bottom area 1*e* of the convex portion 1*d* of the rubber sheet 1 may occupy 40 to 60 percent of an area of the opening 5*d* of the frame sheet 5 in a plan view.

Figure 3A:
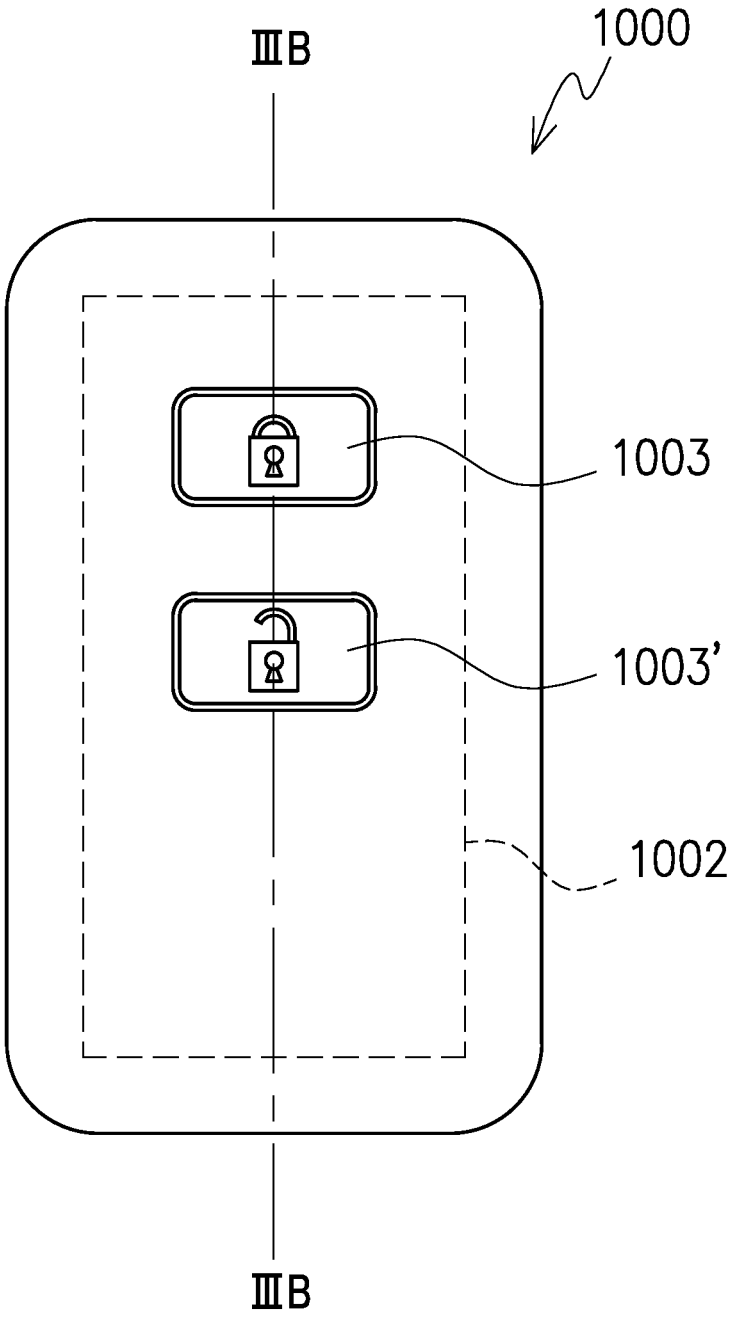
FIG. 3A is a plan view of an electronic device including an electronic switch according to an embodiment of the present application.
Figure 3B:
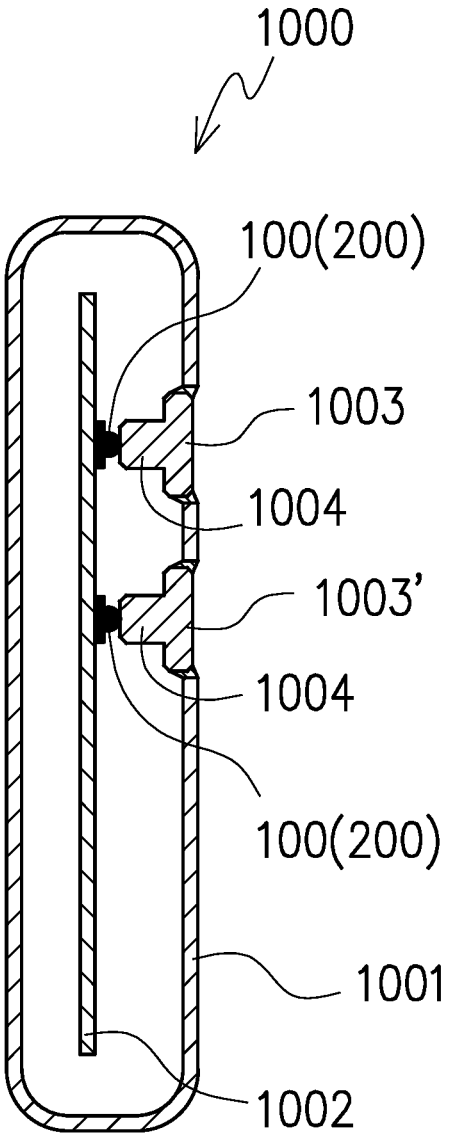
FIG. 3B is a cross-sectional view of the electronic device, taken along a dot-and-dash line IIIB-IIIB of FIG. 3A.

FIG. 3A and FIG. 3B illustrate an electronic device 1000 including an electronic switch according to an embodiment of the present application.

The electronic device 1000 may be a remote control device according to an embodiment of the subject matter. The remote control device 1000 includes a circuit board 1002 on which one or more electronic switches according to any embodiment of the subject matter is electrically mounted.

The electronic device 1000 includes the circuit board 1002, and the first and second electronic switches 100 (200) each according to an embodiment of the subject matter. The first and second electronic switches 100 (200) may be electrically mounted on the circuit board 1002 in a casing 1001 of the electronic device 1000.

The electronic device 1000 may further include first and second key tops 1003, 1003' arranged respectively above the convex portions 1*d* of the rubber sheets 1 of the first and second electronic switches 100 (200). The first and second key tops 1003, 1003' each may include a lower projection 1004 that may be in contact with the convex portion 1*d* of the corresponding rubber sheet 1.

The electronic device 1000 may be a remote control device.

The remote control device 1000 may further include a short-range radio transmitter that is electrically connected to the first switch 100 (200) associated with the first key top 1003 and the second switch 100 (200) associated with the second key top 1003', for example. For locking doors of a vehicle or a building, when the first switch 100 (200) (i.e., the first key top 1003) is pressed down, the transmitter will send a coded signal by infrared and/or radio waves to a receiver unit that is installed in the vehicle or the building. Also, for unlocking the doors of a vehicle or a building, when the second switch 100 (200) (i.e., the second the key top 1003') is pressed down, the transmitter will send a coded signal by infrared and/or radio waves to the receiver unit that is installed in the vehicle or the building.

As illustrated in FIG. 3A and FIG. 3B, the remote control device 1000 may include the circuit board 1002, the first electronic switch 100 (200) that is electrically mounted on the circuit board. The remote control 1000 may further include the second electronic switch 100 (200) that is electrically mounted on the circuit board 1002. However, the number of electronic switches 100 (200) for the remote control device 1000 is not limited to two. The remote control device 1000 may only include one electronic switch 100 (200) or may include three or more electronic switches 100 (200) depending on the application in which the remote control device 1000 is being used.

The push switch according to the subject matter herein may be arranged horizontally and/or vertically in and/or on an electronic device.

Various electronic devices include push switches. An electronic device includes the push switch according to an embodiment of the subject matter, and a motherboard includes a first electrode and a second electrode. The push switch may be electrically connected to the first electrode and the second electrode of the motherboard of the electronic device.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

What is claimed is:

1. An electronic switch comprising:

a substrate comprising a first surface, a second surface opposite to the first surface, a first electrode positioned on the first surface, and a second electrode positioned on the first surface around the first electrode;

a frame sheet comprising a first surface, a second surface opposite to the first surface, and an opening that penetrates the frame sheet from the first surface to the second surface, the frame sheet being arranged on the first surface of the substrate;

a spring plate comprising a central portion, a peripheral portion around the central portion, a top portion of the central portion that comprises a dome shape, and a lower portion of the peripheral portion, the spring plate being arranged in the opening of the frame sheet, the central portion of the spring plate being positioned over the first electrode, and the lower portion of the peripheral portion being positioned on the second electrode;

a protrusion that is arranged in contact with the top portion of the central portion of the spring plate;

a cover sheet comprising a first surface and a second surface opposite to the first surface; and a rubber sheet comprising a first surface, a second surface opposite to the first surface, and a convex portion on the first surface, the second surface of the rubber sheet being in contact with the first surface of the cover sheet, wherein the protrusion is positioned on the second surface of the cover sheet, the second surface of the cover sheet being adhered to the first surface of the frame sheet to seal the spring plate and the protrusion, wherein the spring plate is positioned under the protrusion positioned on the second surface of the cover sheet in the opening of the frame sheet that is arranged on the first surface of the substrate, wherein the convex portion of the rubber sheet comprises a bottom area with a diameter that is fit in the opening of the frame sheet in a plan view and has a height that is in a range of 50 to 100 percent of a length of a diameter at the bottom area, and the convex portion further comprises a semispherical shape rounded as a whole except for the bottom area and having a rounded top, and wherein the first surface of the cover sheet and the first surface of the rubber sheet face away from the substrate, and the second surface of the cover sheet and the second surface of the rubber sheet face toward the substrate.

2. The electronic switch according to claim 1, wherein the substrate further comprises a first through-hole that is electrically connected to a first contact and a second through-hole that is electrically connected to a second contact.

3. The electronic switch according to claim 1, wherein the spring plate comprises two or more spring plates.

4. The electronic switch according to claim 1, wherein the convex portion of the rubber sheet is filled with a material identical to a material of the rubber sheet.

5. The electronic switch according to claim 1, wherein the bottom area of the convex portion of the rubber sheet occupies 40 to 60 percent of an area of the opening of the frame sheet in the plan view.

* * * * *